US010245870B2

(12) United States Patent
Misaizu et al.

(10) Patent No.: US 10,245,870 B2
(45) Date of Patent: Apr. 2, 2019

(54) IMAGE FORMING APPARATUS AND PRINTED SHEET

(71) Applicant: FUJI XEROX CO., LTD., Tokyo (JP)

(72) Inventors: Toru Misaizu, Kanagawa (JP); Mizuki Sugino, Kanagawa (JP); Daisuke Tanaka, Kanagawa (JP); Masaru Okutsu, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 7 days.

(21) Appl. No.: 15/442,783

(22) Filed: Feb. 27, 2017

(65) Prior Publication Data

US 2018/0056694 A1 Mar. 1, 2018

(30) Foreign Application Priority Data

Aug. 29, 2016 (JP) ..... 2016-166682

(51) Int. Cl.

| | |
|---|---|
| ***G03G 15/00*** | (2006.01) |
| ***B41M 5/50*** | (2006.01) |
| ***G03G 15/22*** | (2006.01) |

(52) U.S. Cl.

CPC ..... *B41M 5/502* (2013.01); *G03G 15/00* (2013.01); *G03G 15/224* (2013.01); *G03G 15/6582* (2013.01); *G03G 15/6585* (2013.01)

(58) Field of Classification Search

CPC .... G03G 15/00; G03G 15/224; G03G 15/225; G03G 15/6582; G03G 15/6585; G03G 2215/00789; G03G 2215/00801; B41M 5/502

See application file for complete search history.

(56) References Cited

U.S. PATENT DOCUMENTS

2006/0133845 A1* 6/2006 Savitzky ..... G03G 15/36 399/84

FOREIGN PATENT DOCUMENTS

JP 10-301357 A 11/1998
JP 2001-083760 A 3/2001

* cited by examiner

*Primary Examiner* — Sophia S Chen
(74) *Attorney, Agent, or Firm* — Sughrue Mion, PLLC

(57) ABSTRACT

An image forming apparatus includes a transport unit that transports a sheet and an image forming section that forms an image region formed of a toner layer that enables information written on the sheet, which has been transported by the transport unit, by using a whiteboard marker to be erased by using a whiteboard eraser.

5 Claims, 9 Drawing Sheets

FIG. 5

Table1

| TONER LAYER PATTERN | NONE | ONE SOLID LAYER | TWO SOLID LAYERS | THREE SOLID LAYERS | FOUR SOLID LAYERS |
|---|---|---|---|---|---|
| EVALUATION RESULT | D | C | C | D | D |

Table2

| TONER LAYER PATTERN | ONE SOLID LAYER + LADDER | ONE SOLID LAYER + GRID | ONE SOLID LAYER + DOT | TWO SOLID LAYERS + LADDER |
|---|---|---|---|---|
| EVALUATION RESULT | A | B | C | C |

IMAGE FORMING APPARATUS AND PRINTED SHEET

CROSS-REFERENCE TO RELATED APPLICATIONS

This application is based on and claims priority under 35 USC 119 from Japanese Patent Application No. 2016-166682 filed Aug. 29, 2016.

BACKGROUND

(i) Technical Field

The present invention relates to an image forming apparatus and a printed sheet.

(ii) Related Art

In the related art, a wide variety of studies have been conducted in order to improve image quality by using an electrophotographic system. For example, a transparent toner (clear toner) has been used merely for improving image quality, such as glossiness, and an image processing technology using the electrophotographic system in the related art has been only used for improving image quality.

SUMMARY

According to an aspect of the invention, there is provided an image forming apparatus including a transport unit that transports a sheet and an image forming section that forms an image region formed of a toner layer that enables information written on the sheet, which has been transported by the transport unit, by using a whiteboard marker to be erased by using a whiteboard eraser.

BRIEF DESCRIPTION OF THE DRAWINGS

An exemplary embodiment of the present invention will be described in detail based on the following figures, wherein:

FIG. 5 illustrates tables showing evaluation results of drawing patterns formed in the whiteboard mode;

DETAILED DESCRIPTION

An exemplary embodiment of the present invention will be described in detail below with reference to the accompanying drawings.

[Description of Image Forming Apparatus]

Figure 1:
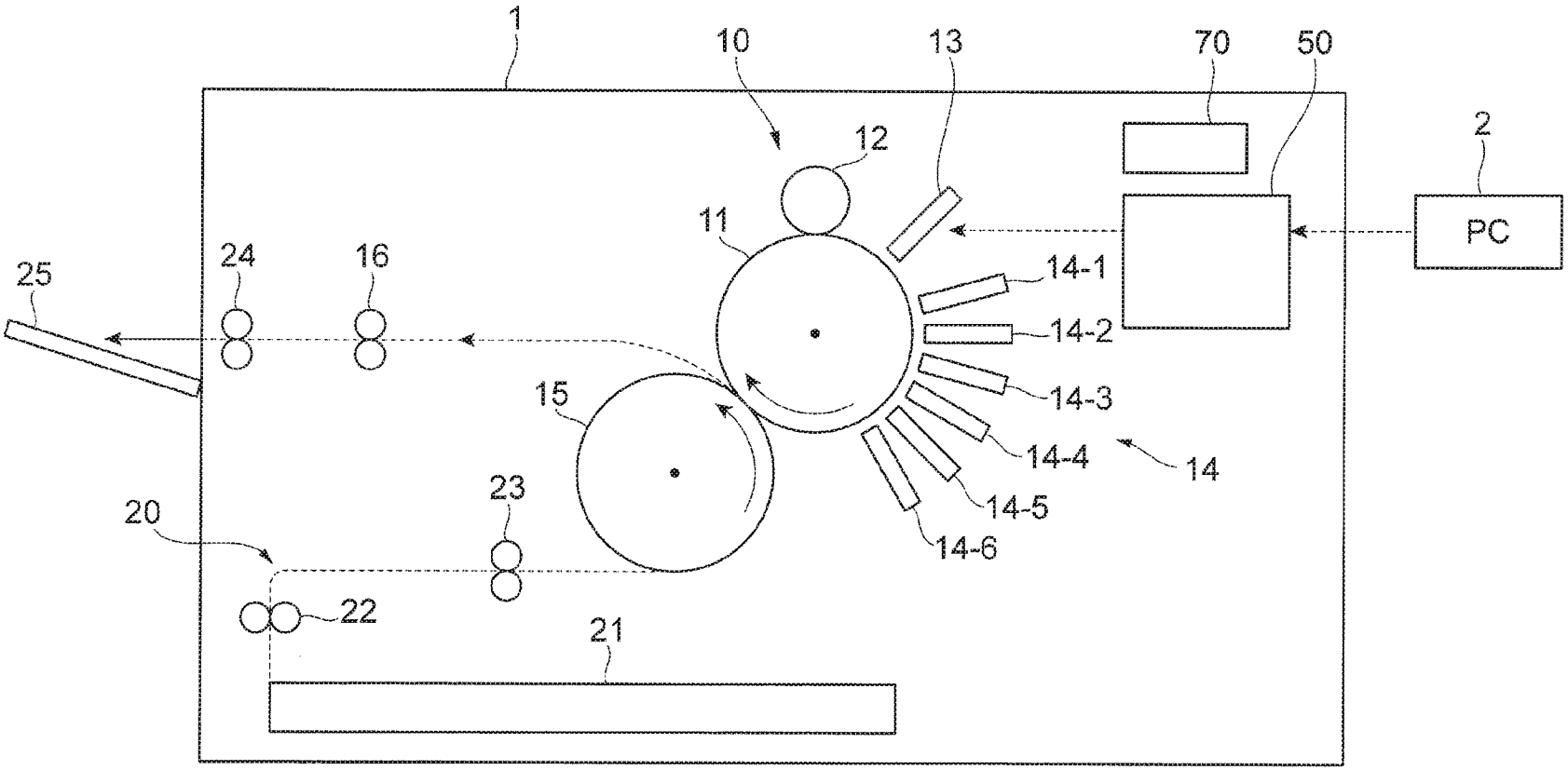
FIG. 1 is a diagram illustrating an image forming apparatus according to an exemplary embodiment of the present invention.

FIG. 1 is a diagram illustrating an image forming apparatus 1 according to the present exemplary embodiment. The image forming apparatus 1 employs an electrophotographic system and forms an image onto a sheet by using toners. More specifically, the image forming apparatus 1 includes an image forming section 10 and a transport unit 20 that transports a sheet to the image forming section 10 and ejects a sheet, on which an image has been formed by the image forming section 10, to the outside of the image forming apparatus 1. The image forming apparatus 1 further includes an image processing unit 50 that performs predetermined image processing on image data of an electronic document output by, for example, a client personal computer (PC) 2. In addition, the image forming apparatus 1 includes a control panel 70 that displays operation information of the image forming apparatus 1 to a user and receives an operation from a user.

For example, the image forming section 10 includes a photoconductor unit 11 formed of a photoconductor drum, a charging unit 12 that charges the photoconductor unit 11, an exposure unit 13 that exposes the photoconductor unit 11, which has been charged by the charging unit 12, to light, and a developing unit 14 that develops an electrostatic latent image formed on the photoconductor unit 11, which has been exposed to light by the exposure unit 13. The image forming section 10 further includes a transfer unit 15 that transfers a toner image developed on the photoconductor unit 11 by the developing unit 14 onto a sheet and a fixing unit 16 that fixes a toner image, which has been transferred to a sheet by the transfer unit 15, onto the sheet by applying heat and pressure to the toner image.

The developing unit 14 includes a Y developing unit 14-1 that develops an electrostatic latent image into an yellow (Y) toner image, an M developing unit 14-2 that develops an electrostatic latent image into a magenta (M) toner image, a C developing unit 14-3 that develops an electrostatic latent image into a cyan (C) toner image, and a K developing unit 14-4 that develops an electrostatic latent image into a black (K) toner image. The developing unit 14 further includes a first clear-toner developing unit 14-5 and a second clear-toner developing unit 14-6 each of which is used for developing an electrostatic latent image with a transparent toner (clear toner).

A full-color image forming apparatus that is generally used includes, instead of the developing unit 14, four developing units, which respectively correspond to the colors Y, M, C, and K. In the case where the present exemplary embodiment is employed in these four developing units of the general full-color image forming apparatus, for example, a configuration obtained by changing colors used in a common full-color image forming apparatus in such a manner that a black-toner developing unit is provided at the position of the Y developing unit, a first clear-toner developing unit is provided at the position of the M developing unit, a second clear-toner developing unit is provided at the position of the C developing unit, and the position of the K developing unit is an auxiliary space may be employed.

In FIG. 1, the clear toner used by the first clear-toner developing unit 14-5 and the clear toner used by the second clear-toner developing unit 14-6 may be manufactured by using a method the same as that used for manufacturing toners of chromatic colors, which are Y, M, C, and K, and in this case, a color material is not added during the process of manufacturing the chromatic color toners. Regarding the particle diameter of each of the toners used by the developing units included in the developing unit 14, in the case where the particle diameter is small, the amount of a toner charged so as to have an opposite polarity increases, and accordingly, background fog is likely to be generated. In contrast, in the case where the particle diameter is large, the toner particles are visible, and the granularity is disturbed. Consequently, toners each having a suitable particle diameter are used.

The transport unit 20 includes a sheet-feeding tray 21 that feeds a sheet and transport rollers 22 that send out and transport a sheet from the sheet-feeding tray 21. The transport unit 20 further includes registration rollers 23 that transport a sheet, which has been transported by the transport rollers 22, to the transfer unit 15 in accordance with the timing at which image formation is performed. In addition, the transport unit 20 includes ejection rollers 24 that eject a sheet, to which a toner image has been fixed by the fixing unit 16, to the outside of the image forming apparatus 1 and a sheet-ejection tray 25 that holds a sheet ejected by the ejection rollers 24. Although not illustrated, other rollers used for transporting a sheet, a transport-path-forming member, and the like are provided.

Figure 2:
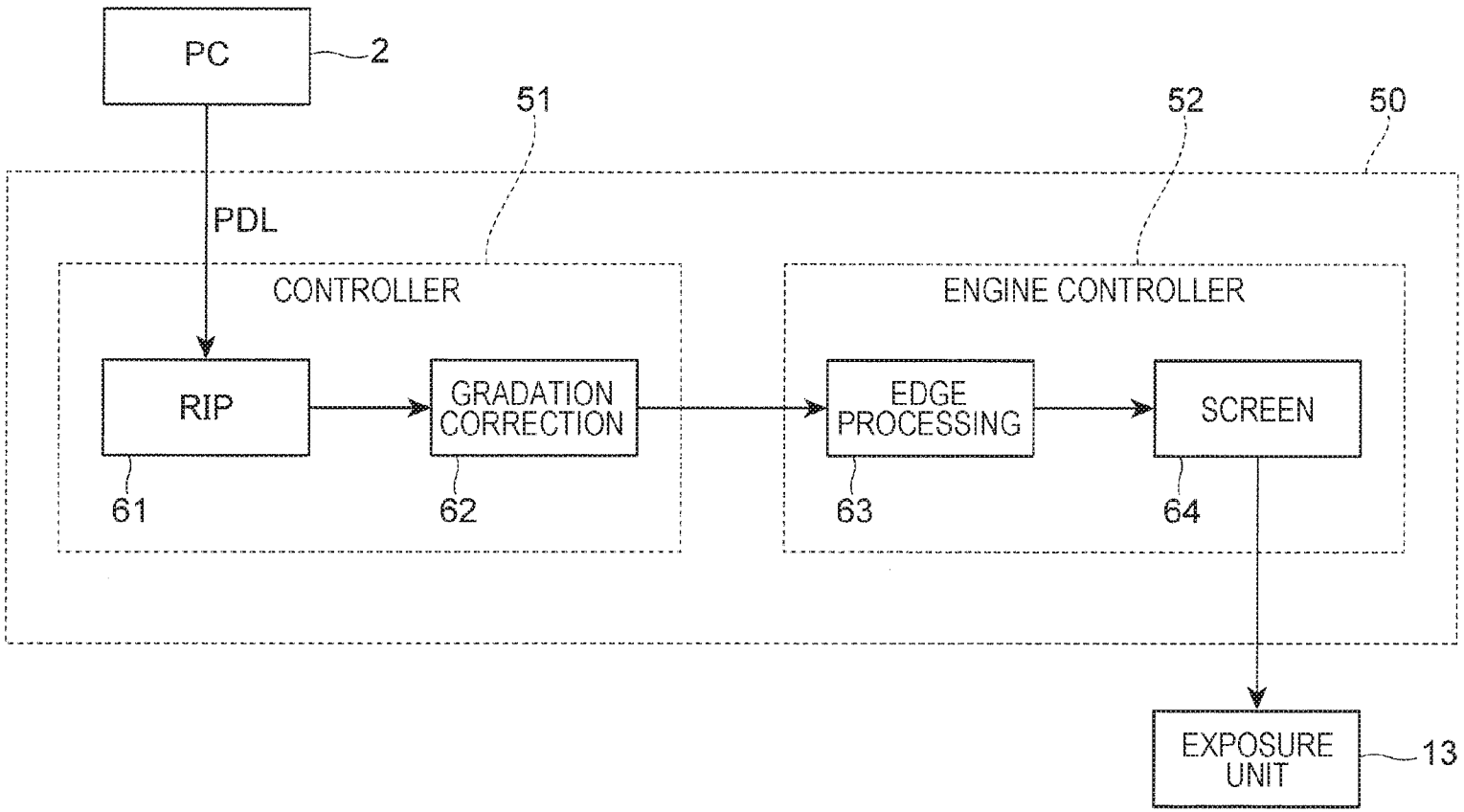
FIG. 2 is a block diagram illustrating the configuration of an image processing unit according to the present exemplary embodiment.

FIG. 2 is a block diagram illustrating the configuration of the image processing unit 50 according to the present exemplary embodiment. The components of the image processing unit 50 may be broadly divided into a controller 51 and an engine controller 52. The controller 51 includes a raster-image processor (RIP) 61 that performs command interpretation on a page description language (PDL) sent from the client PC 2 via a network or the like and that converts the PDL into a printable bitmap format. The controller 51 further includes a gradation-correction unit 62 that performs gradation correction on data rasterized by the RIP 61. The engine controller 52 includes an edge-processing unit 63 and a screen-processing unit 64. The edge-processing unit 63 detects, for example, an edge of each pixel, determines the attribute of a detected edge, and applies a predetermined look-up table (LUT) to the edge. The screen-processing unit 64 applies a predetermined screen to an edge on the basis of the attribute of the edge determined by the edge-processing unit 63. Here, screen processing is binarization processing, such as a dither method, which is one of area gradation methods, and uses a threshold matrix that is stored beforehand in a memory (not illustrated) or the like. Pulse width modulation is performed on image data, on which screen processing has been performed by the screen-processing unit 64, and the image data is output to the exposure unit 13.

Figure 3:
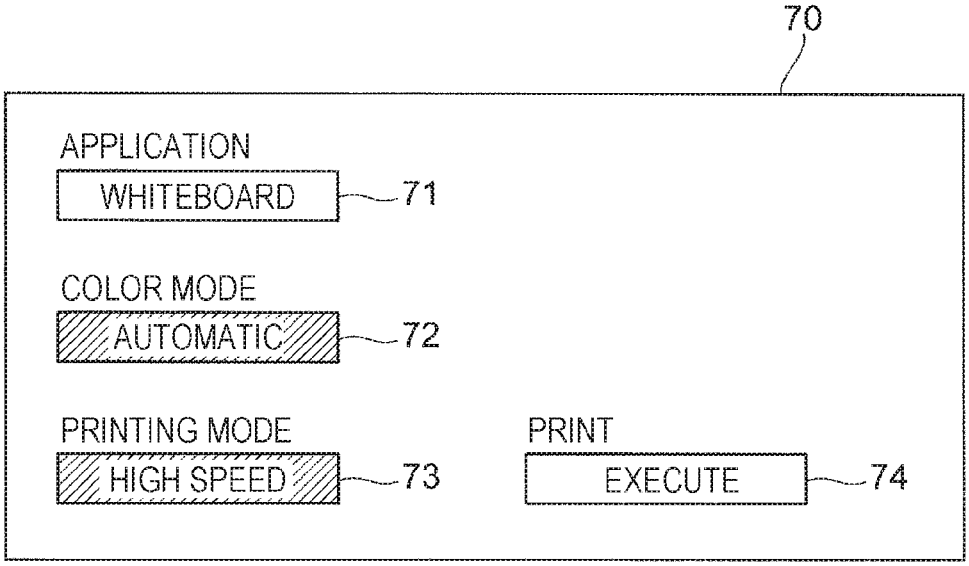
FIG. 3 is a diagram illustrating an example of a screen of a control panel.

FIG. 3 is a diagram illustrating an example of a screen of the control panel 70. In FIG. 3, a driver user interface (UI) screen is displayed on a display of the control panel 70. In the driver UI screen, an application display 71, a color mode display 72, a printing mode display 73, and a print instruction button 74 are displayed. Selectable application examples in the application display 71 include "normal document" and "whiteboard". Selectable mode examples in the color mode display 72 include "automatic", "color document", and "monochrome document". Selectable mode examples in the printing mode display 73 include "high speed", "standard", and "high image quality". In the example illustrated in FIG. 3, the "whiteboard" included in the driver UI is selected in the application display 71. In this "whiteboard" mode, a special operation that is not a normal printing operation is performed. Thus, in the example illustrated in FIG. 3, the color mode display 72 and the printing mode display 73 are displayed in a so-called grayed-out state so as to be removed from items that are to be operated by a user.

[Description of Whiteboard Mode]

The whiteboard mode according to the present exemplary embodiment will now be described. In the related art, although a wide variety of studies have been conducted in order to improve image quality by using an electrophotographic system, studies on values other than image quality have been rarely conducted. In the present exemplary embodiment, for example, a commercially available (common) sheet, such as a P sheet that is manufactured by Fuji Xerox Co., Ltd. and that has a basis weight of 64 g/m$^2$ and a sheet thickness of 88 μm as its basic specifications or an SP sheet that is manufactured by Fuji Xerox Co., Ltd. and that has a basis weight of 60 g/m$^2$ and a sheet thickness of 81 μm as its basic specifications, is provided with the whiteboard function by using a clear toner. In other words, the whiteboard function is provided by devising an image drawing method in the present exemplary embodiment, and a commercially available sheet is provided with an added value by performing image formation under certain conditions. More specifically, a so-called whiteboard function is provided by making use of the on-demand characteristic of a printer (image forming apparatus 1) in order to enable anyone to hold a meeting or a class anywhere. The whiteboard function enables an idea written on a sheet by using for example, a commercially available pen or a whiteboard marker, to be quickly modified (erased).

Figure 4A:
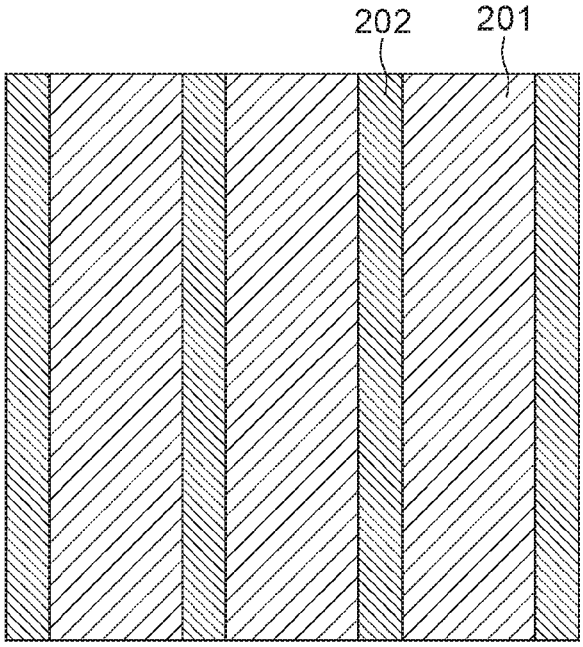
FIGS. 4A and 4B are diagrams illustrating a drawing example of a printed sheet formed in a whiteboard mode according to the present exemplary embodiment.
Figure 4B:
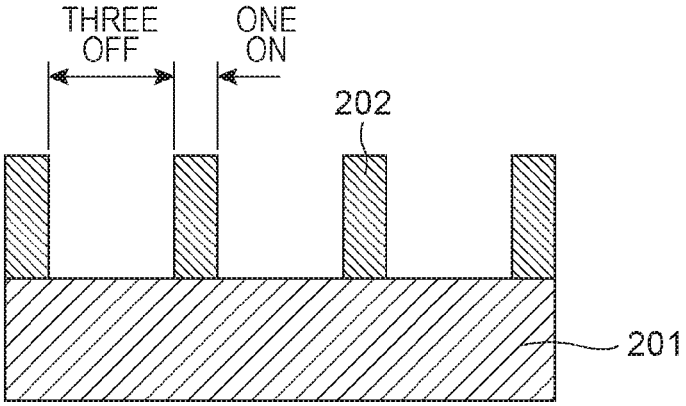

FIGS. 4A and 4B are diagrams illustrating a drawing example of a printed sheet formed in the whiteboard mode according to the present exemplary embodiment. FIG. 4A is an enlarged schematic diagram illustrating a minute, certain rectangular region of the printed sheet when viewed from above (from a surface of the sheet), and FIG. 4B is an enlarged schematic diagram illustrating the certain rectangular region of the printed sheet illustrated in FIG. 4A when viewed in the lateral direction. The sheet is not illustrated in FIG. 4B. In the drawing example illustrated in FIGS. 4A and 4B, a first layer 201 is a solid image (solid-image region) having a density of 100%. Regarding a second layer 202, which is an uppermost layer, a 1-on-3-off ladder pattern image in which one line is on (1-on), and three lines are off (3-off) is employed as a pattern image. Here, a ladder pattern is a pattern in which regions in each of which the second layer 202 is not formed and regions in each of which the second layer 202 is formed are alternately formed in a transport direction of the sheet. Note that, as the first layer 201, a toner image may be formed on the entire surface of the sheet, and the first layer 201 may be formed of a solid image whose density is set to be higher than 100%.

From another perspective, it may be said that, when the sheet is viewed in the lateral direction, the above-described drawing example includes first surface portions each having a first height and second surface portions each having a second height, the first height corresponding to a distance from the surface of the sheet to a surface of the second layer 202, which is the uppermost layer, (a surface to which an ink is to be applied by using a whiteboard marker) and the second height corresponding to a distance from the surface of the sheet to a surface of a portion of the first layer 201 on which the second layer 202 is not formed (a surface to which an ink will not be applied by using a whiteboard marker). In addition, it may be said that the first surface portions are formed so as to be higher than the second surface portions, and the first surface portions and the second surface portions are alternately arranged.

[Evaluation Results of Drawing Patterns]

FIG. 5 illustrates tables showing evaluation results of drawing patterns formed in the whiteboard mode. The tables include "toner layer patterns" and "evaluation results", and experimental results indicating whether information written by using a whiteboard marker is erased by using a whiteboard eraser and whether other defects occur are shown as the "evaluation results".

In the whiteboard mode according to the present exemplary embodiment, an ink containing an alcohol as a main solvent is used in a whiteboard marker that is used for writing erasable information, and accordingly, the whiteboard marker is a so-called alcohol ink marker. The ink contains pigment as a coloring agent and contains a resin and a release agent as additives. As described above, the ink of the whiteboard marker according to the present exemplary embodiment contains an alcohol, which is a main solvent, a resin, a release agent, and the like that are mixed with one another, and the solvent starts being volatilized first after the ink has been deposited on a surface of an image formed in the whiteboard mode. After that, the resin forms a coating film for the pigment, and the coating film is separated from the surface of the image such that only the release agent is deposited on the surface of the image. Subsequently, when the surface of the image is wiped by using a whiteboard eraser, the coating film, which has been separated from the surface of the image, is peeled off together with the release agent, and as a result, the written information is erased.

Table 1 of FIG. 5 will now be described.

First, in the toner layer pattern "none", the sheet is not coated, and when information is written on the sheet by using a whiteboard marker, the ink of the marker penetrates the sheet, and it is difficult to erase the information even by using a whiteboard eraser. Thus, the evaluation result is "D".

Next, in the toner layer pattern "one solid layer", only a 100% solid image is formed as the first layer 201 by using a clear toner, and accordingly, the sheet is coated with the clear toner. Thus, the ink is less likely to penetrate the sheet. However, it is difficult to sufficiently erase information written on the sheet even by using the whiteboard eraser, and although it is easier to erase the information, the information is not completely erased. Thus, the evaluation result is "C", which is not particularly good. Note that, in the toner layer pattern "one solid layer", the thickness of the toner layer is set to about 5 μm, and theoretically, similar results may be obtained in the case where a 100% solid image is formed by using a toner having a small diameter such that the toner layer has a thickness of about 4 μm.

In the toner layer pattern "two solid layers", in addition to form a 100% solid image as the first layer 201 by using the clear toner, another 100% solid image is also formed as the second layer 202 by using another clear toner. Accordingly, similar to the toner layer pattern "one solid layer", the sheet is coated with the clear toners, and the ink is less likely to penetrate the sheet. However, it is difficult to sufficiently erase information written on the sheet even by using the whiteboard eraser, and although it is easier to erase the information, the information is not completely erased. Thus, the evaluation result is "C", which is not particularly good. Note that, in the toner layer pattern "two solid layers", the thickness of each of the toner layers is set to about 10 μm.

Next, in the toner layer pattern "three solid layers", in addition to the first layer 201 and the second layer 202, another 100% solid image is formed as a third layer. When the sheet is bent, cracks are generated in the toner layers, and the ink penetrates the cracks and will not be erased. Thus, the evaluation result is "D", which is unfavorable. Note that, in the toner layer pattern "three solid layers", the thickness of each of the toner layers is set to about 15 μm.

In the toner layer pattern "four solid layers", in addition to the first layer 201 and the second layer 202, another 100% solid images are formed as third and fourth layers. The coating layers break due to a pressure generated when fixing the toner layers in places, and cracks are generated in the coating layers. As a result, the ink enters the cracks and penetrates the sheet, and the ink will not be erased. Thus, the evaluation result is "D", which is unfavorable. Note that, in the toner layer pattern "four solid layers", the thickness of each of the toner layers is set to about 20 μm.

As described above, since information may be somewhat erased in the toner layer pattern "one solid layer", in which the toner layer has a thickness of 4 to 5 μm, the evaluation result is "C". Although the toner layer pattern "two solid layers", in which each of the toner layers has a thickness of 8 to 10 μm, is more favorable than the toner layer pattern "one solid layer", there remains the difficulty of erasing information, and thus, the evaluation results is "C". However, in the toner layer pattern "third solid layers", in which each of the toner layers has a thickness of 12 to 15 μm, the evaluation results is "D". Considering the above evaluation results from the standpoint of toner-layer thickness, a thickness larger than 11 μm is unfavorable, and a favorable thickness of a toner layer as a drawing pattern formed in the whiteboard mode is 4 μm or about 4 μm to 10 μm or about 10 μm.

Table 2 of FIG. 5 will now be described. Since it is apparent from the experimental results shown in Table 1 that using two layers is favorable, studies are conducted on the pattern of the second layer 202 in Table 2.

First, a 100% solid image is formed as the first layer 201 by using a clear toner, and a clear-toner uppermost layer is formed as the second layer 202 by using another clear toner in such a manner as to form the 1-on-3-off ladder pattern illustrated in FIG. 4 (one solid layer+ladder). When writing is performed on the toner layer pattern by using the whiteboard marker, the coating layers formed of the clear toners do not break, and the ink is neatly deposited only on protruding portions. Thus, the ink deposited only on the protruding portions may easily be wiped off by using a whiteboard eraser. In other words, in a printed sheet formed in the whiteboard mode, the evaluation result of the performance of the toner layer pattern is "A", which is excellent.

Note that, although the 1-on-3-off ladder pattern is highly evaluated in the above experimental result, an optimum setting of the ladder pattern period differs according to the characteristics of an image forming apparatus. It is understood from the results of examination of the ladder pattern that favorable results related to erasing the ink may be obtained when the area ratio of predetermined gaps in the ladder pattern is 50% or higher, that is, the area ratio of the second layer 202 is lower than 50%.

Next, a 100% solid image is formed as the first layer 201 by using the clear toner, and a grid image is formed as the second layer 202 (one solid layer+grid). The information that has been written by using the whiteboard marker is wiped off by using the whiteboard eraser. However, since the ink remains on some portions of the sheet, the evaluation result is "B", which is acceptable.

Next, a 100% solid image is formed as the first layer 201 by using the clear toner, and an image of dots is formed as the second layer 202 (one solid layer+dot). The information that has been written by using the whiteboard marker is not sufficiently wiped off and is not sufficiently erased by using the whiteboard eraser. Although it is easier to erase the information, the information is not completely erased. Thus, the evaluation result is "C", which is not particularly good. However, the evaluation may be improved depending on the way in which the image region is formed including the sizes and the arrangement of the dots.

Next, 100% solid images are formed as the first layer 201 and the second layer 202, and a 1-on-3-off ladder pattern similar to the second layer 202 illustrated in FIG. 4B is formed as a third layer image (two solid layers+ladder). Although it is favorable that the information that has been written by using the whiteboard marker is erased by using the whiteboard eraser, some portions of the toner layers have a large thickness of about 15 μm, and there are cases where cracks and warpage occur in the toner layers, and where the ink enters the cracks afterwards and will not be erased. Thus, the evaluation result is "C", which is not particularly good.

[Processing in Whiteboard Mode]

Figure 6:
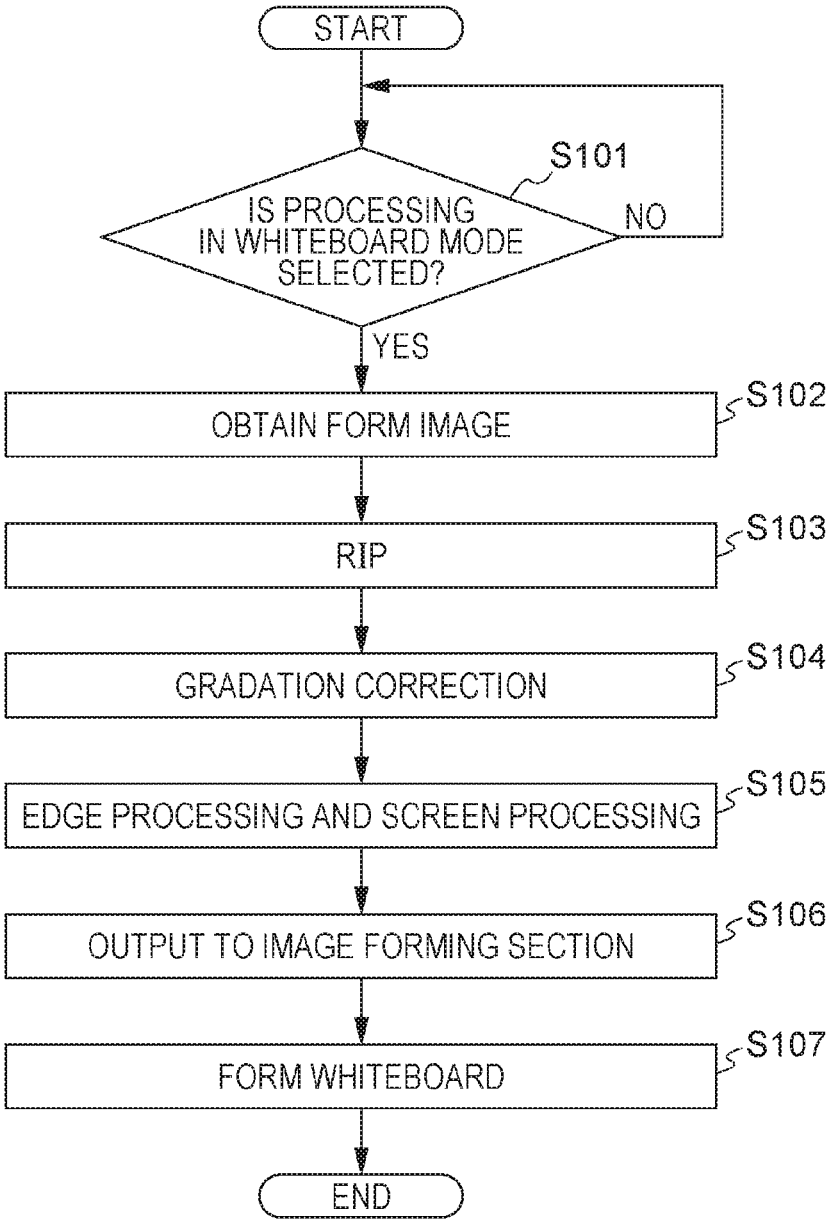
FIG. 6 is a flowchart illustrating the flow of processing in the whiteboard mode.

Processing in the whiteboard mode according to the present exemplary embodiment will now be described with reference to FIG. 2, FIG. 3, and FIG. 6. FIG. 6 is a flowchart illustrating the flow of the processing in the whiteboard mode that are to be performed by the image processing unit 50, which functions as one of controllers, the control panel 70, the image forming section 10 and the like.

First, it is determined whether white-board mode processing in the driver UI has been selected (step S101). In the case where a user has selected the application "whiteboard" in the application display 71 and has pressed the print instruction button 74 via the driver UI screen displayed on the control panel 70 such as that illustrated in FIG. 3 (YES in step S101), the processing continues to step S102, and in the case where the user has not selected the application "whiteboard" (NO in step S101), the processing waits for the application "whiteboard" to be selected.

In the case where the white-board mode processing has been selected in step S101 (YES in step S101), a special operation that is not a normal printing operation is started. First, the controller 51 of the image processing unit 50 obtains a form image that is desired to be used by a user from, for example, the client PC 2 (step S102). In the case of obtaining such a form image, for example, it may be considered that a user creates beforehand a template form image that is desired to be used by the user (e.g., a hiragana character for educational use, a formation sheet for sport instruction, or the like) by using the client PC 2 or the like and drawing software. A printer manufacturer provides a standard form image in the form of, for example, a PDL document, and such a standard form image may be stored beforehand in, for example, a memory device of the client PC 2 or the like and may be read from the memory device as necessary. Alternatively, instead of obtaining a form image, an illustration image in which a photograph, a character, and a figure, such as a frame, are arranged or a text image may be used.

The controller 51 of the image processing unit 50, which has obtained, for example, a PDL document from the client PC 2 in step S102, first causes the RIP 61 to convert the PDL document into a printable bitmap format (step S103). Here, the form image is rasterized as, for example, a black printing plate, and when the application "whiteboard" is selected, a first clear toner and a second clear toner are respectively and forcibly rasterized as a 100% solid printing plate corresponding to the first layer 201 (see FIGS. 4A and 4B) and a 1-on-3-off ladder pattern corresponding to the second layer 202 (see FIGS. 4A and 4B).

Next, the controller 51 of the image processing unit 50 causes the gradation correction-unit 62 to perform gradation correction on the form image, which is, for example, a black printing plate (step S104). In the solid image corresponding to the first layer 201 and the ladder pattern image corresponding to the second layer 202, which are formed of the corresponding clear toners, portions where images are formed are 100% images, and thus, the processing performed by the gradation correction-unit 62 may be bypassed, or the gradation correction may be performed because all the portions will be held as they are whether or not the gradation correction is performed.

After that, the form image, such as a black printing plate, the clear-toner image corresponding to the first layer 201, and the clear-toner image corresponding to the second layer 202 are sent to the engine controller 52. Then, edge processing and screen processing are respectively performed by the edge-processing unit 63 and the screen-processing unit 64 on the form image (step S105). In the solid image corresponding to the first layer 201 and the ladder pattern image corresponding to the second layer 202, which are formed of the corresponding clear toners, portions where images are formed are 100% images, and thus, the processing performed by the screen-processing unit 64 may be bypassed, or the screen processing may be performed because all the portions will be held as they are whether or not the screen processing is performed.

Subsequently, the image data, which has undergone the processing performed by the engine controller 52, is output to the exposure unit 13 of the image forming section 10 (step S106). In the image forming section 10, the photoconductor unit 11 illustrated in FIG. 1 is charged by the charging unit 12 first, and a laser beam is radiated onto the charged photoconductor unit 11 by the exposure unit 13 in accordance with a pulse signal obtained by converting the image data. In the photoconductor unit 11, the electrical characteristics of portions change as a result of the portions being irradiated with the laser beam. Next, the toners are sent out from the developing unit 14, and the toners are deposited onto the photoconductor unit 11 in accordance with the electrical characteristics. Then, the toners on the photoconductor unit 11 are transferred onto a sheet by the transfer unit 15. After that, the toner images on the sheet are fixed onto the sheet as a result of being heated and pressurized by the fixing unit 16. An on-demand whiteboard is manufactured through the above processes (step S107), and the processing is exited. Note that, in the present exemplary embodiment, three printing plates, which are the form image, the clear-toner image corresponding to the first layer 201, and the clear-toner image corresponding to the second layer 202, are collectively subjected to the exposure, development, transfer, and fixing processes. However, a printed sheet, which is a whiteboard, may be formed by performing a so-called overprinting in which the exposure, development, transfer, and fixing processes are repeated for each printing plate.

[Applications of Whiteboard Mode]

Figure 7A:
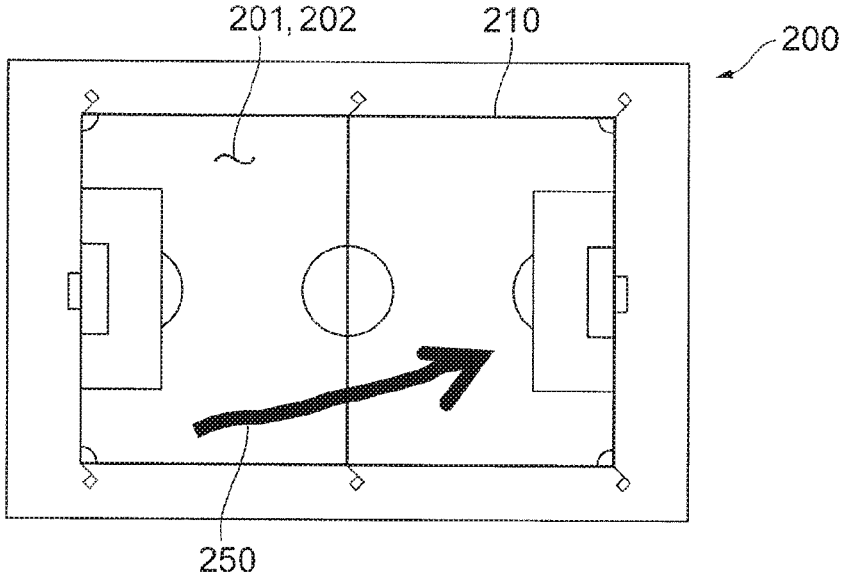
FIGS. 7A to 7C are diagrams illustrating examples of printed sheets, which are formation sheets, as applications of the whiteboard mode.
Figure 7B:
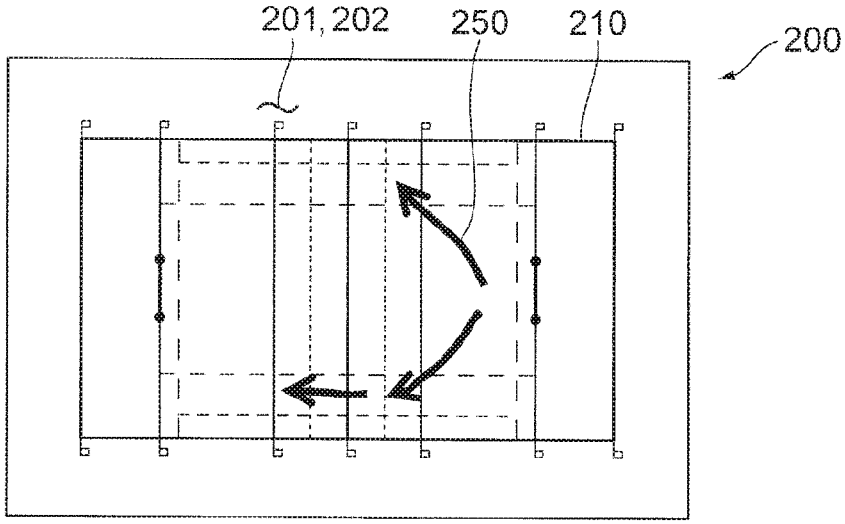
Figure 7C:
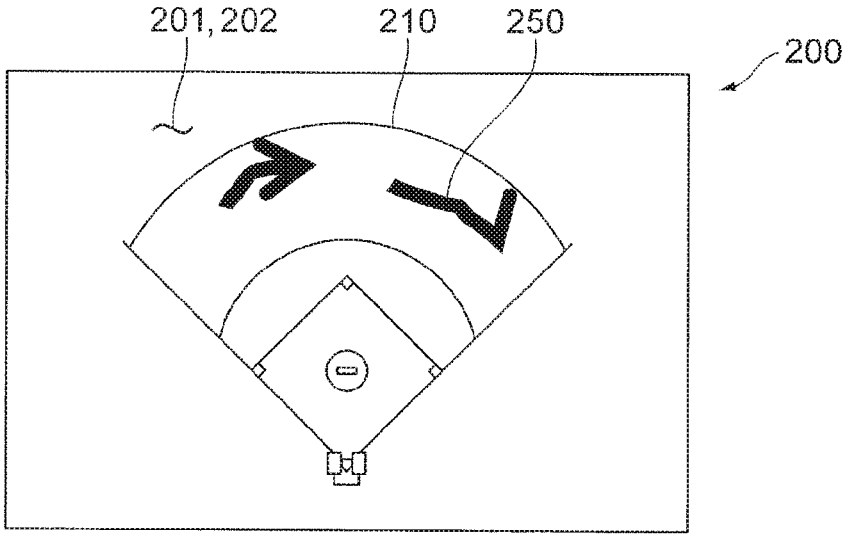

FIGS. 7A to 7C are diagrams illustrating examples of printed sheets 200, which are formation sheets, as applications of the whiteboard mode. FIG. 7A, FIG. 7B, and FIG. 7C respectively illustrate a soccer formation sheet, a rugby formation sheet, and a baseball formation sheet. The printed sheets 200 include form images 210 and illustrate schematic diagrams of a soccer ground, a rugby ground, and a baseball ground, respectively. A clear-toner image corresponding to the first layer 201 and a clear-toner image corresponding to the second layer 202 such as those illustrated in FIGS. 4A and 4B are formed on the entire region of each of the sheets in such a manner as to be located above the corresponding form image 210. More specifically, the clear-toner image corresponding to the first layer 201 and the clear-toner image corresponding to the second layer 202 are respectively a 100% solid image and a 1-on-3-off ladder pattern, and an image region including a region above the form image 210 is formed in the entire printable area of each of the sheets. A user writes, for example, formation information 250, which indicates movement of players, by using a whiteboard marker. The user may erase the information 250 by using a whiteboard eraser. In addition, after the information 260 has been erased, new information 260 may be written by using the whiteboard marker.

Figure 8:
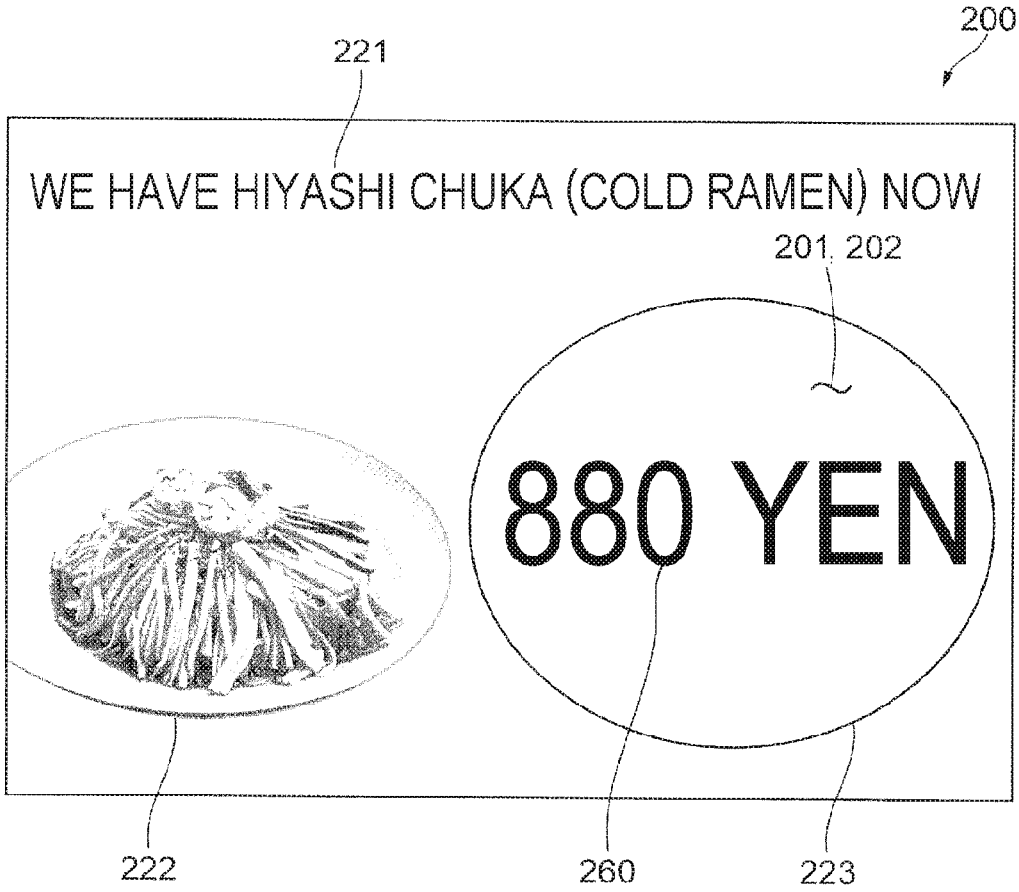
FIG. 8 is a diagram illustrating another application of the whiteboard mode.

FIG. 8 is a diagram illustrating another application of the whiteboard mode. As a form image, a text image 221 and illustration images 222 and 223, such as a photograph and a line drawing, are written on the printed sheet 200 illustrated in FIG. 8. For example, a clear-toner image corresponding to the first layer 201 and a clear-toner image corresponding to the second layer 202 are formed in a region surrounded by the line drawing, which is the illustration image 223. In other words, an image region formed of a toner layer that enables information written by using a whiteboard marker to be erased by using a whiteboard eraser is formed in the region surrounded by the line drawing, which is the illustration image 223. A user writes, for example, variable information 260, such as price, by using a whiteboard marker. The user may erase the information 260 by using a whiteboard eraser. In addition, after the information 260 has been erased, new information 260 may be written by using the whiteboard marker. Note that the clear-toner image corresponding to the first layer 201 and the clear-toner image corresponding to the second layer 202 may be formed on the entire surface of the printed sheet 200.

[Another Drawing Example in Whiteboard Mode]

Figure 9A:
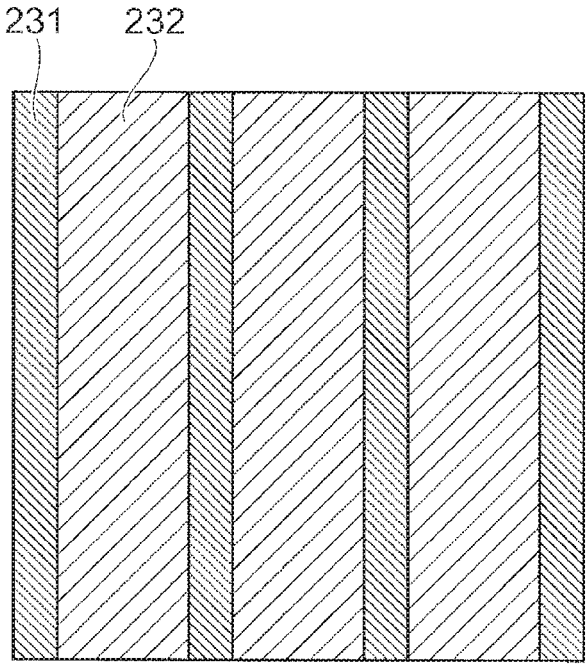
FIGS. 9A and 9B are diagrams illustrating a modification of the drawing example of the printed sheet illustrated in FIGS. 4A and 4B.
Figure 9B:
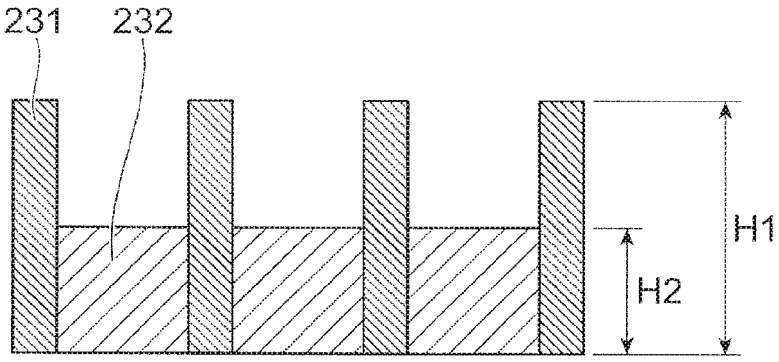

FIGS. 9A and 9B are diagrams illustrating a modification of the drawing example of the printed sheet illustrated in FIGS. 4A and 4B. FIG. 9A is an enlarged schematic diagram illustrating a minute, certain rectangular region of a printed sheet when viewed from above (from a surface of the sheet), and FIG. 9B is an enlarged schematic diagram illustrating the certain rectangular region of the printed sheet illustrated in FIG. 9A when viewed in the lateral direction. The sheet is not illustrated in FIG. 9B. In the drawing example illustrated in FIGS. 9A and 9B, a first surface portion 231 having a first height H1 and a second surface portion 232 having a second height H2 are formed in such a manner that the first height H1 and the second height H2 are different from each other. Regarding a method of forming images corresponding to the first surface portion 231 and the second surface portion 232, first, the first surface portion 231 and the second surface portion 232 are formed of 100% solid images. In addition, a line at which a potential recess amount becomes large by increasing the light exposure of the exposure unit 13 is provided so as to vary the deposition amounts of the toners, so that the difference in height between the first surface portion 231 and the second surface portion 232 is generated. Such images may be formed as a result of the image processing unit 50 performing control.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transport unit that transports a sheet; and an image forming section that forms an image region formed of a toner layer that enables information written on the sheet, which has been transported by the transport unit, by using a whiteboard marker to be erased by using a whiteboard eraser, wherein, in the image region formed by the image forming section, a pattern image having a predetermined gap is formed as an uppermost layer by using a clear toner, and a solid image is formed as a layer excluding the uppermost layer.

2. The image forming apparatus according to claim 1, wherein the image forming section forms one or both of a text and an image and forms the image region such that the image region is superposed with one or both of the text and the image and/or is formed in another region.

3. The image forming apparatus according to claim 1, wherein a whiteboard mode, which is a mode in which the image forming section forms the image region, is selectably displayed to a user, and wherein the image forming section is controlled, as a result of the user making a selection, so as to proceed to formation of the image region.

4. The image forming apparatus according to claim 1, wherein the image region comprises a first layer of clear toner having full coverage in the image region, and a second layer of clear toner that partial coverage in the image region.

5. The image forming apparatus according to claim 4, wherein the second layer is formed on the first layer.

* * * * *